US007335903B1

(12) United States Patent
Yang et al.

(10) Patent No.: US 7,335,903 B1
(45) Date of Patent: Feb. 26, 2008

(54) DETACHABLE BILL ACCEPTOR MOUNTING ARRANGEMENT

(75) Inventors: Ya-Huei Yang, Taitung Hsien (TW); Wei-Jr Chen, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 11/656,966

(22) Filed: Jan. 24, 2007

(51) Int. Cl.
*G07F 9/10* (2006.01)

(52) U.S. Cl. ..... 250/566; 209/577; 209/534; 109/45

(58) Field of Classification Search ..... 250/566; 209/534, 576, 577; 109/45; 194/206; 235/379
See application file for complete search history.

(56) References Cited

U.S. PATENT DOCUMENTS 4,784,274 A * 11/1988 Mori et al. ..... 209/534
5,209,395 A * 5/1993 Zouzoulas et al. ..... 232/15
6,352,175 B2 * 3/2002 Izawa et al. ..... 221/197
2006/0021848 A1 * 2/2006 Smith ..... 194/350
2006/0180428 A1 * 8/2006 Yoshioka ..... 194/206

* cited by examiner

*Primary Examiner*—John R. Lee
(74) *Attorney, Agent, or Firm*—Birch, Stewart, Kolasch & Birch, LLP

(57) ABSTRACT

A detachable bill acceptor mounting arrangement includes a face panel of a vending machine, the face panel having two protruding locating plates at two sides and an angled guide groove at each protruding locating plate, and a bill acceptor formed of a lower unit and an upper unit, the lower unit having two recessed locating portions detachably coupled to the protruding locating plates of the face panel and two pair of stub guide rods insertable into the angled guide grooves to secure the lower unit to the face panel, the upper unit having two flat pivot rods detachably coupled to a respective pivot hole on the lower unit and two hooks releasably hooked in a respective retaining slot on the lower unit to lock the upper unit to the lower unit.

8 Claims, 13 Drawing Sheets

DETACHABLE BILL ACCEPTOR MOUNTING ARRANGEMENT

BACKGROUND OF THE INVENTION

1. Field of the Invention

The present invention relates to a vending machine and more specifically, to a detachable bill acceptor mounting arrangement for vending machine, which allows quick mounting/dismounting of the bill acceptor for easy performance of maintenance work.

2. Description of the Related Art

Following fast development of transportation and communication technology, non-shop business has become popular. Nowadays, various automatic vending machines (card dispensers, ticket vending machines, coin exchanging machines, etc.) are used everywhere to sell different products without serviceman. The use of automatic vending machines creates new marketing routes for the suppliers, saves much labor cost, and brings convenience to consumers. Further, an automatic vending machine has a bill acceptor provided on the inside for receiving and verifying bills.

A regular bill acceptor includes three units, i.e., the bill conveyer, the bill validator and the bill box. As shown in FIGS. 12 and 13, the bill acceptor A is affixed to the back side of the face panel B of the vending machine (not shown). The face panel B has a bill slot B1 into which the user inserts a bill. After insertion of the bill into the bill slot B1, the bill conveyer A1 of the bill acceptor A is started to carry the inserted bill forwards, and the bill validator (not shown) verifies the authenticity and value of the bill. After verification of the received bill to be true bill, the bill is carried into the bill box (not shown).

According to the aforesaid design, the bill acceptor A is fixedly fastened to the face panel B with screws C. In case a bill is jammed in the bill acceptor A, the mechanic must use a screwdriver to dismount the screws C, and then detach the bill acceptor A from the face panel B for troubleshooting. Further, the internal parts of the bill acceptor A, for example, the movable parts of the bill conveyer and the sensor of the bill validator tend to be covered with dust and dirt carried on the received bills. Accumulation of dust and dirt on the parts of the bill conveyer and the sensor of the bill validator A will affect normal functioning of the bill conveyer and the bill validator. When a cleaning work is necessary, the mechanic must dismount the screws C and then detach the bill acceptor A from the face panel B of the vending machine. It is complicated to mount and dismount the bill acceptor A. Further, the screws C may be lost easily during dismounting of the bill acceptor A from the face panel B.

Therefore, it is desirable to provide a detachable bill acceptor mounting arrangement that eliminates the aforesaid problem.

SUMMARY OF THE INVENTION

The present invention has been accomplished under the circumstances in view. According to one aspect of the present invention, the detachable bill acceptor mounting arrangement comprises a vending machine's face panel, and a bill acceptor formed of a lower unit and an upper unit and detachably fastened to the back side of the face panel. The lower unit of the bill acceptor has two recessed location portions and two stub guide rods in each recessed location portion. The face panel has two horizontal guide grooves and two vertical guide grooves linked to the horizontal guide grooves for receiving the stub guide rods. After insertion of the stub guide rods into the vertical guide grooves through the horizontal guide grooves, the upper unit is closed on the lower unit to force locating blocks of the upper unit into engagement with respective retaining grooves of the face panel, thereby prohibiting disengagement of the stub guide rods from the vertical guide grooves. Reversing the aforesaid procedure allows removable of the bill acceptor from the face panel.

According to another aspect of the present invention, the mechanic or worker can separate the upper unit from the lower unit after removal of the bill acceptor from the face panel. By pressing finger strips of the upper unit to disengage a respective hook on each finger strip from a corresponding retaining slot on the lower unit and then turning the upper unit from horizontal to vertical and then lifting the upper unit to move flat pivot rods of the upper unit away from respective pivot holes through respective top grooves on the lower unit, the upper unit is separated from the lower unit.

DETAILED DESCRIPTION OF THE PREFERRED EMBODIMENT

Figure 1:
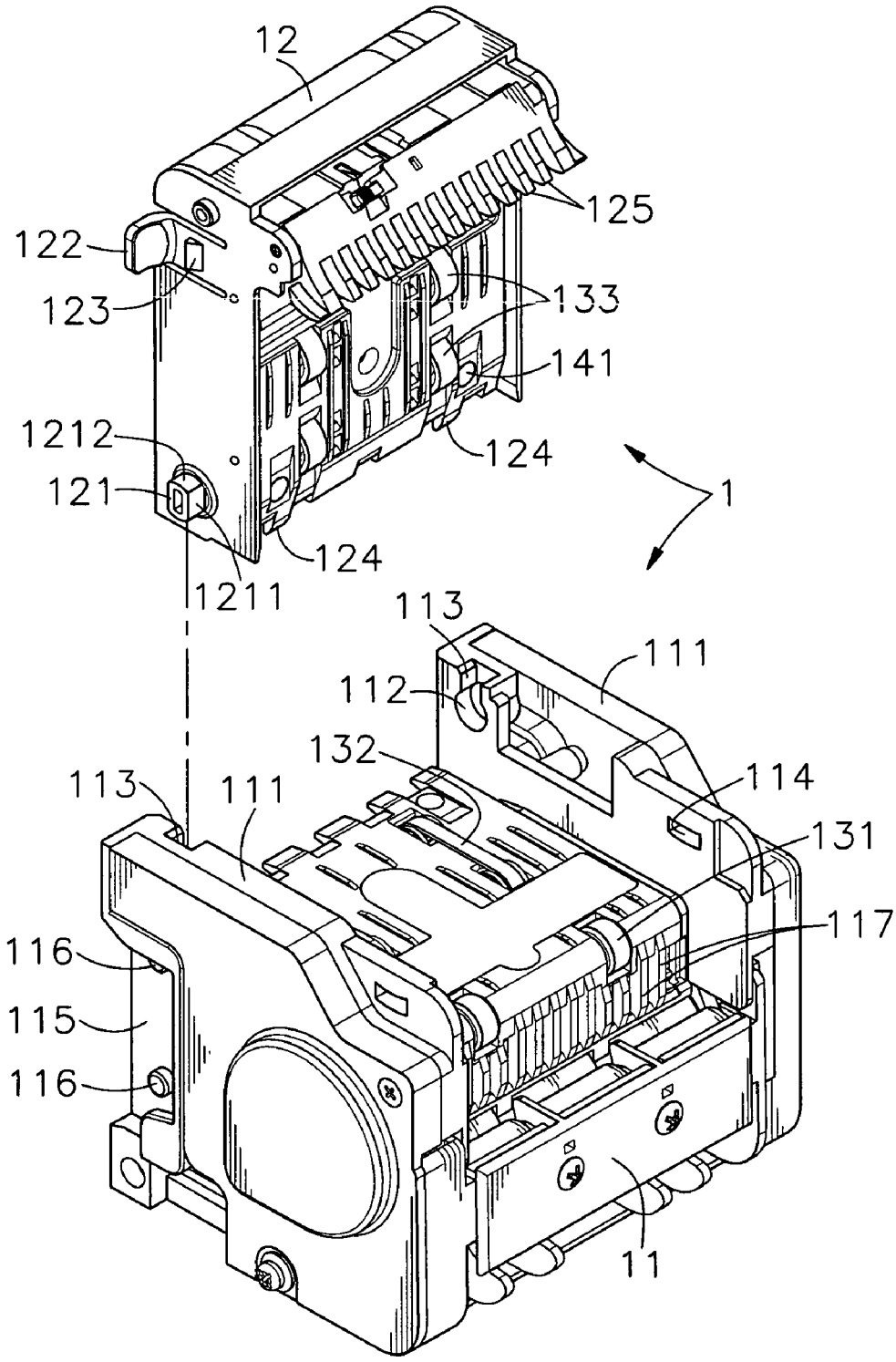
FIG. 1 is an exploded view of a bill acceptor according to the present invention.
Figure 2:
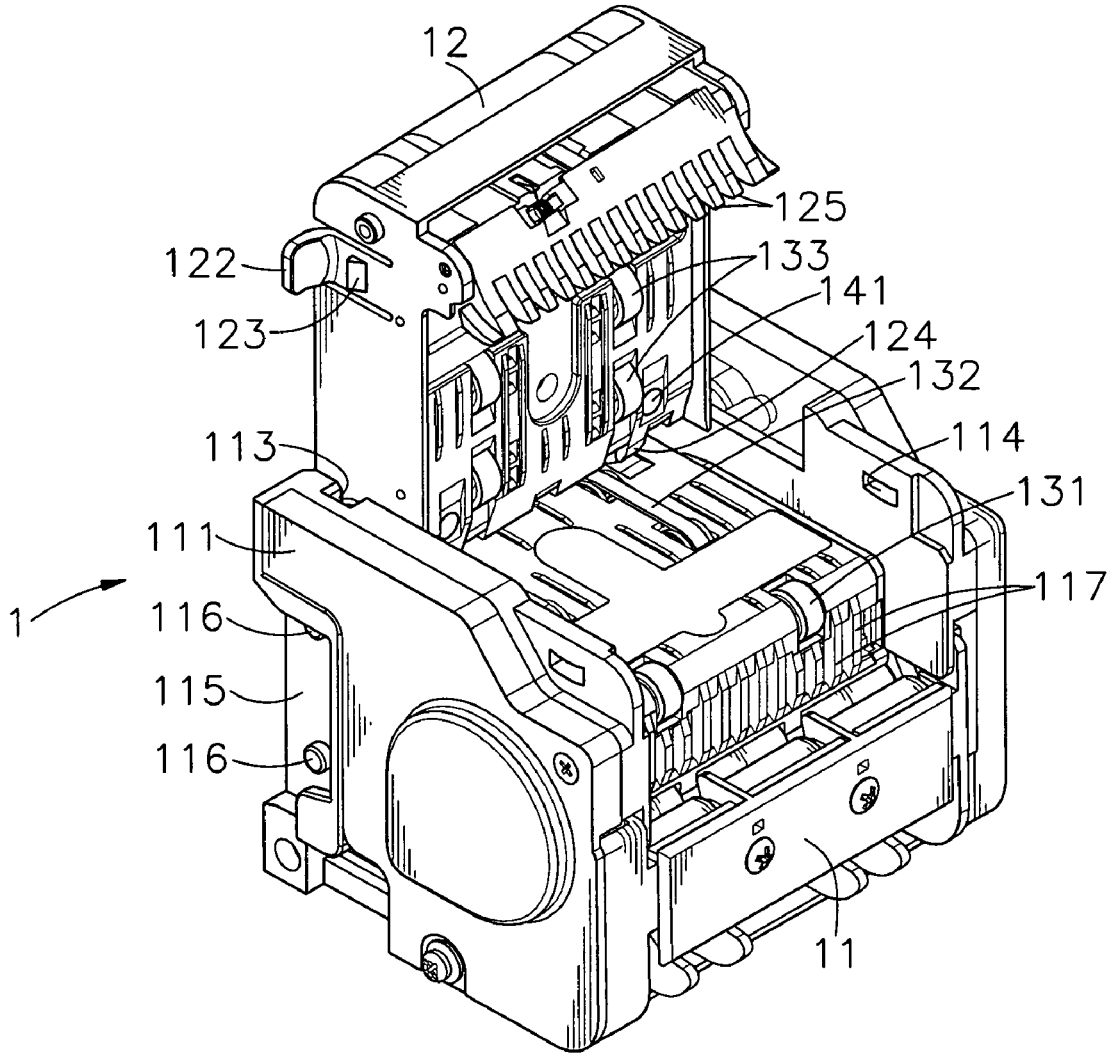
FIG. 2 is a schematic drawing showing the upper unit attached to the lower unit and kept in vertical according to the present invention.
Figure 3:
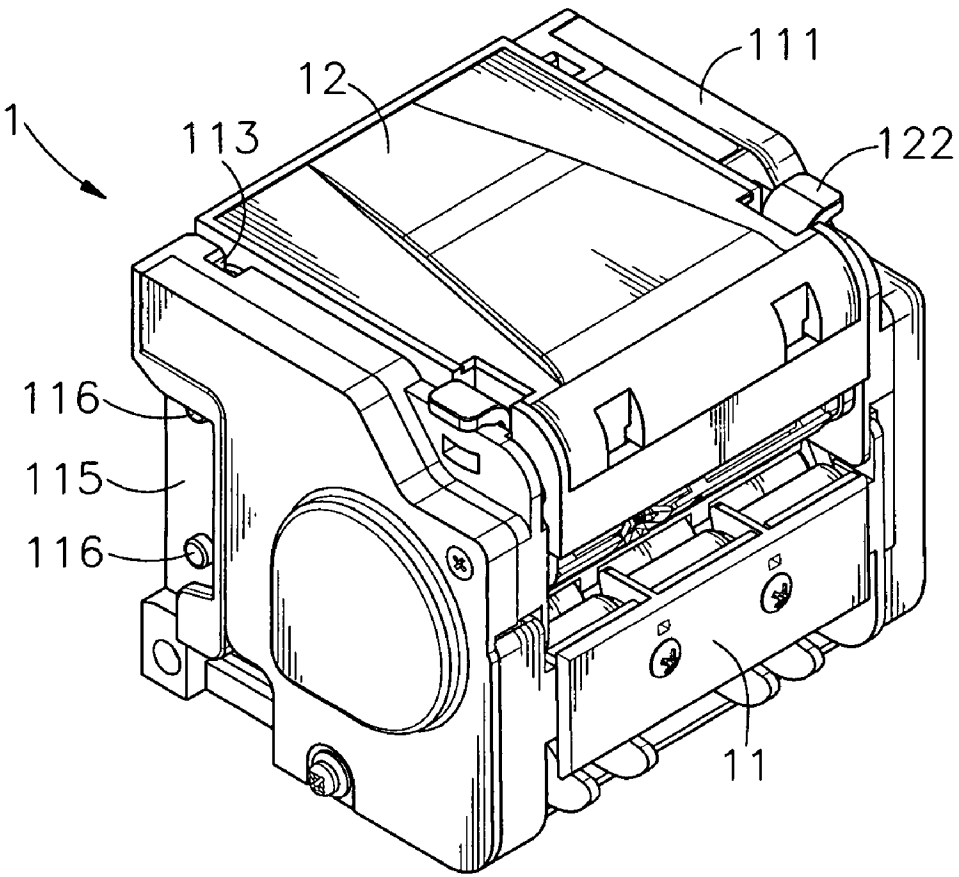
FIG. 3 is an elevational assembly view of the bill acceptor, showing the upper unit closed on the lower unit according to the present invention.
Figure 4:
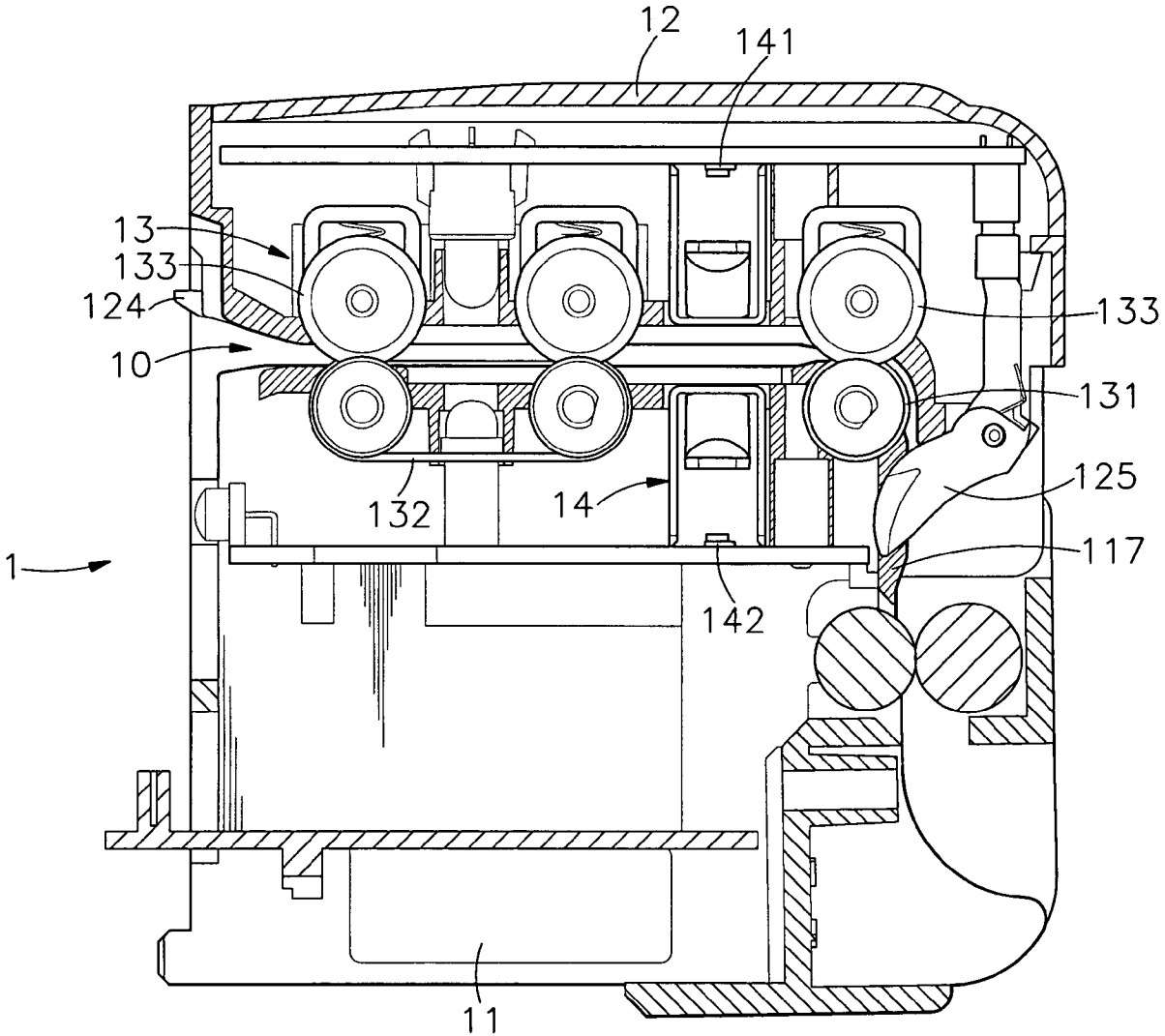
FIG. 4 is a sectional side view of the bill acceptor according to the present invention.
Figure 5:
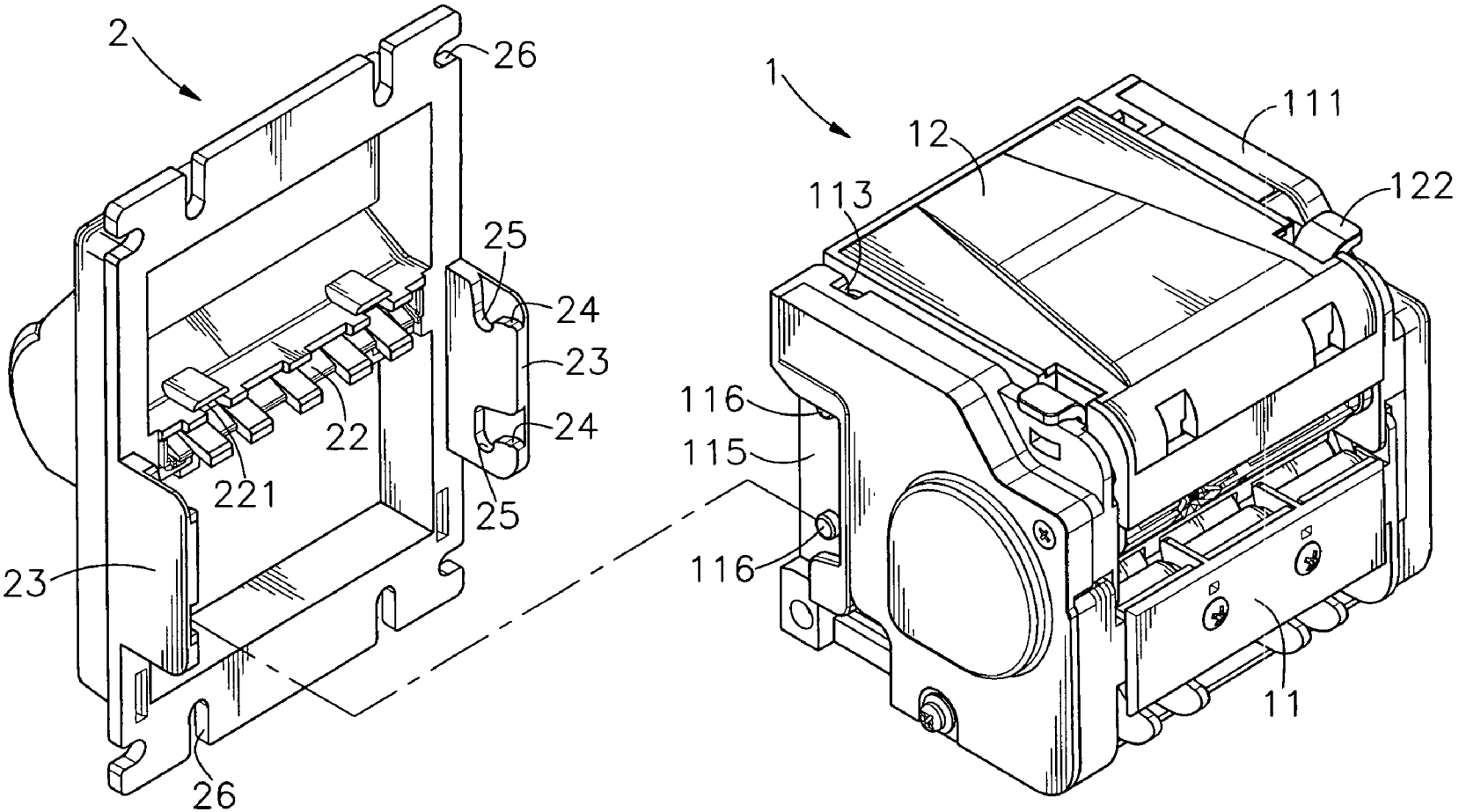
FIG. 5 is an exploded view of the bill acceptor and a vending machine's face panel according to the present invention.
Figure 6:
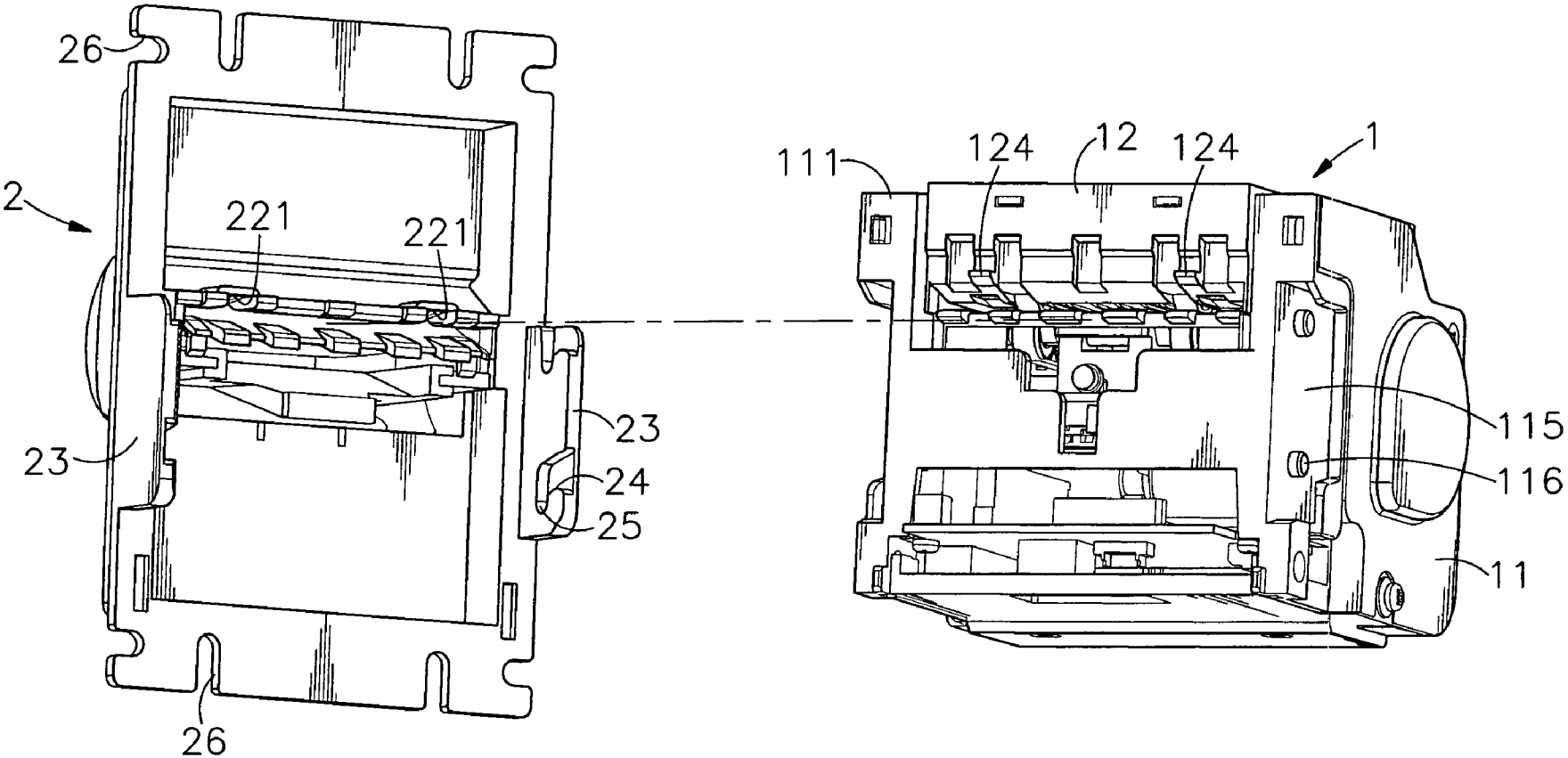
FIG. 6 corresponds to FIG. 5 when viewed from another angle.
Figure 7:
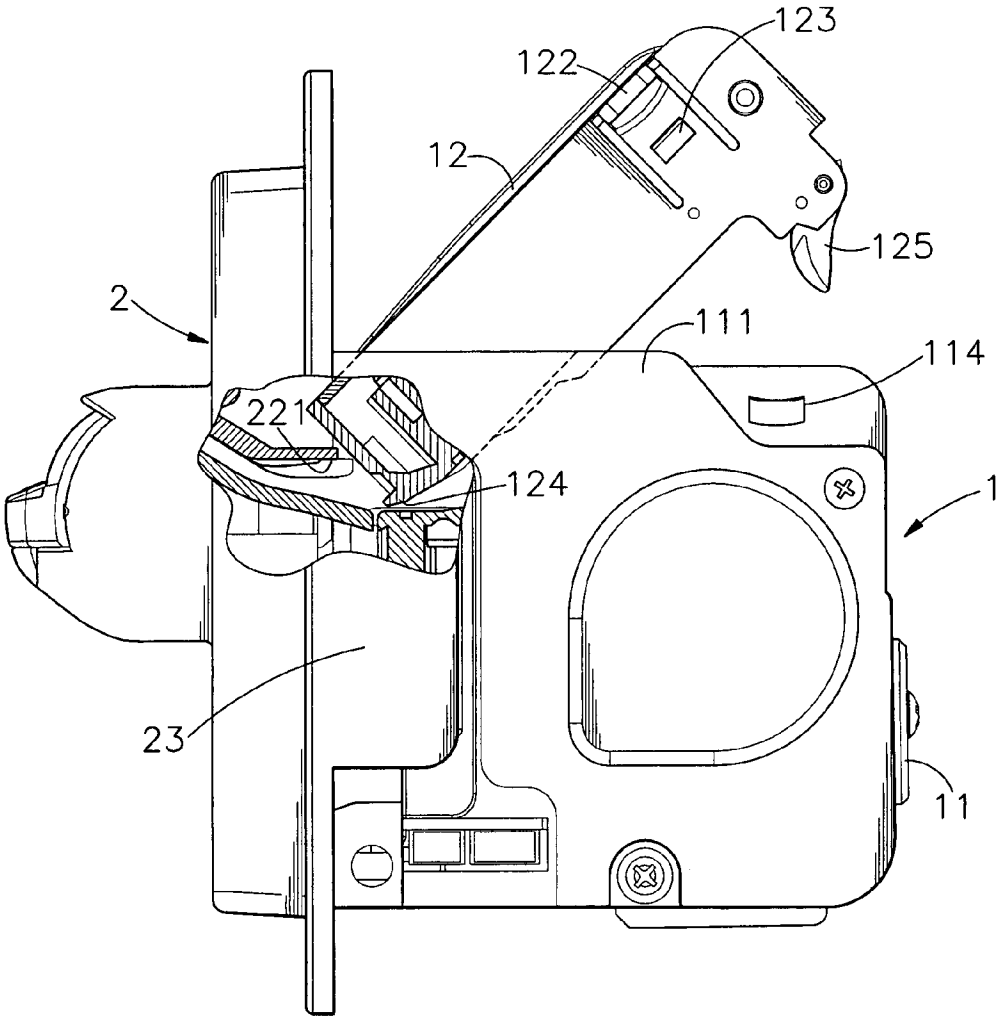
FIG. 7 is a schematic sectional side view showing the lower unit of the bill acceptor fastened to the back side of the face panel and the upper unit of the bill acceptor kept in a tilted position according to the present invention.
Figure 8:
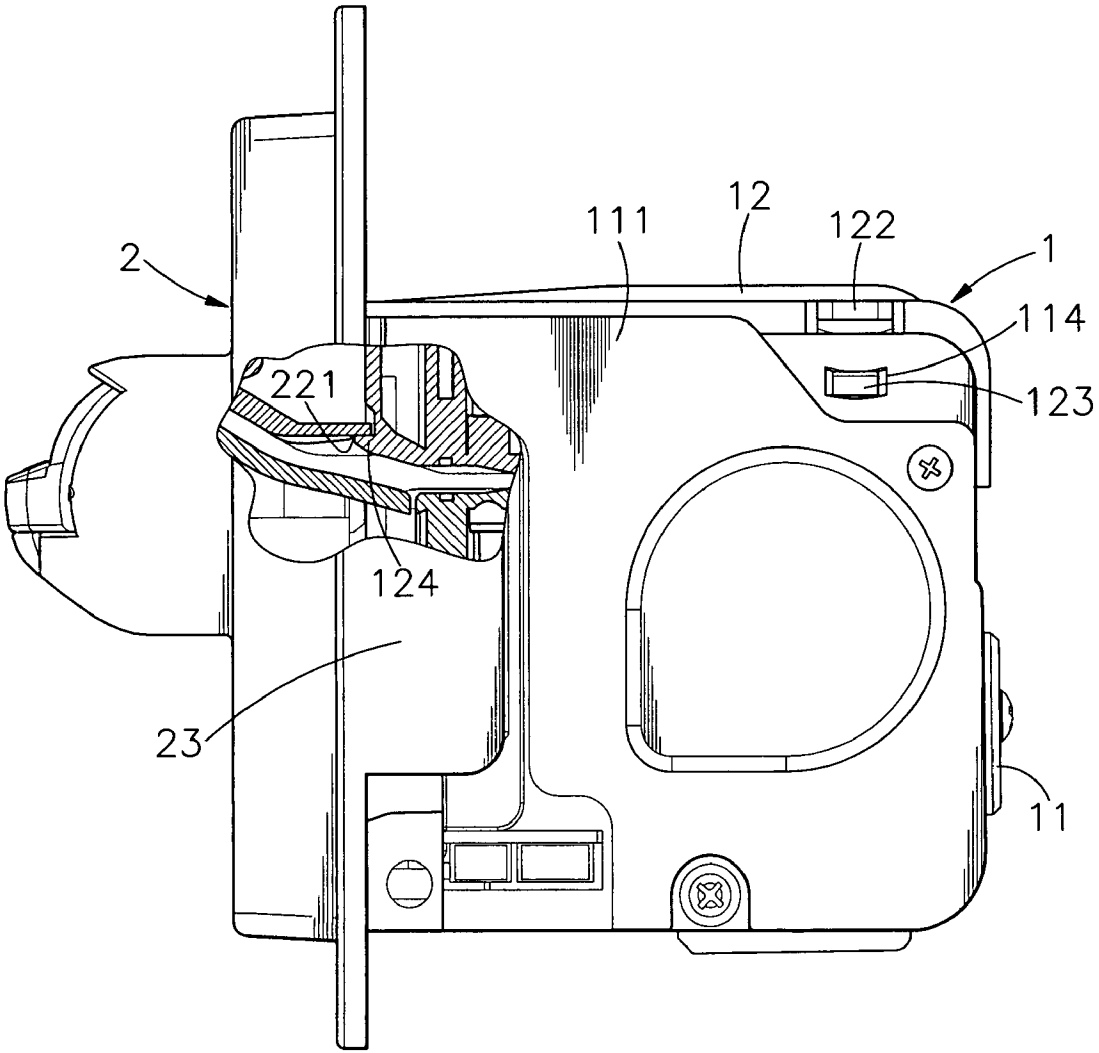
FIG. 8 corresponds to FIG. 7, showing the upper unit of the bill acceptor closed on the lower unit.

Referring to FIGS. 1~4, a bill acceptor 1 in accordance with the present invention is shown comprising a lower unit 11 and an upper unit 12.

The lower unit 11 has two upright side panels 111 arranged in parallel at two opposite lateral sides, and a security gate 117 on the rear side between the two upright side panels 111. Each upright side panel 111 has a pivot hole 112 on the inner wall at the front side near the top, a top groove 113, which extends vertically upwardly from the pivot hole 112 to the topmost edge and has a width smaller than the diameter of the pivot hole 112, a retaining slot 114 near the rear side corresponding to the elevation of the pivot hole 112, a recessed location portion 115 on the outer wall at the front side, and guide means, for example, two stub guide rods 116 suspending in the recessed location portion 115.

The upper unit 12 is vertically downwardly instable into the front side of the lower unit 11 between the two upright side panels 111 from the top, having two flat pivot rods 121 that are respectively protruded from the two opposite lateral sides thereof near the front side and respectively insertable through the top grooves 113 of the upright side panels 111 into the associating pivot holes 112, two finger strips 122 respectively protruded from the two opposite lateral sides near the rear side, two hooks 123 respectively protruded from the outer wall of each of the finger strips 122 for engaging the retaining slots 114 of the upright side panels 111 to lock the upper unit 12 to the lower unit 11, locating blocks 124 extending from the front side, and a row of security hooks 125 suspending in the rear side for engaging into the security gate 117. The flat pivot rods 121 each have two opposite flat peripheral wall portions 1211 and two arched peripheral wall portions 1212.

The bill acceptor 1 further comprises a bill conveyer 13 and a bill validator 14. The bill conveyer 13 comprises a plurality of bill transferring rolls 131 and bill transferring belts 132 mounted in the lower unit 11 for conveying bills, and a plurality of impression rolls 133 pivotally mounted in the upper unit 12 and adapted to press bills on the bill transferring rolls 131 and the bill transferring belts 132 for enabling bills to be delivered to a bill box (not shown). The bill validator 14 is adapted to verify the authenticity and value of the bills carried by the bill conveyer 13, comprising an optical emitter module 141 installed in the upper unit 12, and an optical receiver module 142 installed in the lower unit 11. Because the bill conveyer 13 and the bill validator 14 are of the known art, no further detailed description in this regard is necessary.

During installation, hold the upper unit 12 in vertical above the lower unit 11 to aim the two opposite flat peripheral wall portions 1211 of the flat pivot rods 121 at the top grooves 113 of the upright side panels 111, and then lower the upper unit 12 to insert the flat pivot rods 121 through the top grooves 113 into the associating pivot holes 112 to further have the arched peripheral wall portions 1212 be in contact with the periphery of the associating pivot holes 112, and then turn the upper unit 12 from vertical to horizontal to force the two hooks 123 into engagement with the retaining slots 114 of the upright side panels 111, thereby locking the upper unit 12 to the lower unit 11. When wishing to remove the upper unit 12 from the lower unit 11, press the finger strips 122 to disengage the hooks 123 from the associating retaining slots 114, and then turn the upper unit 12 from horizontal to vertical, and then lift the upper unit 12 to move the flat pivot rods 121 out of the associating pivot holes 112 through the associating top grooves 113.

After the upper unit 12 is locked to the lower unit 11, a bill path 10 is defined between the bottom side of the upper unit 12 and the top side of the lower unit 11. When a bill is inserted into the bill acceptor 1, the bill transferring rolls 131 and the bill transferring belts 132 of the bill conveyer 13 carry the bill through the bill path 10 between the optical emitter module 141 and the optical receiver module 142 of the bill validator 14. During delivery of the bill through the bill path 10, the optical emitter module 141 emits light through the bill, and the optical receiver module 142 receives the light passing through the bill for determining the authenticity of the bill subject to the paper quality, ink, fluorescent fiber, and/or other characteristics of the bill, as well as the value of the bill.

Referring to FIGS. 5~8, the bill acceptor 1 is mounted in the back side of a vending machine's face panel 2. The face panel 2 has a bill slot 21 on the front side, a bill passage 22 backwardly extending from the bill slot 21, two retaining grooves 221 on the back side above the bill passage 22, two protruding locating plates 23 backwardly extending from two opposite lateral sides for engaging into the recessed location portions 115 of the lower unit 11 of the bill acceptor 1, and a plurality of mounting holes 26 around the border. The protruding locating plates 23 each have a horizontal guide groove 24 and a vertical guide groove 25 linked on the inner side for receiving the stub guide rods 116 of the lower unit 11 of the bill acceptor 1.

Figure 9:
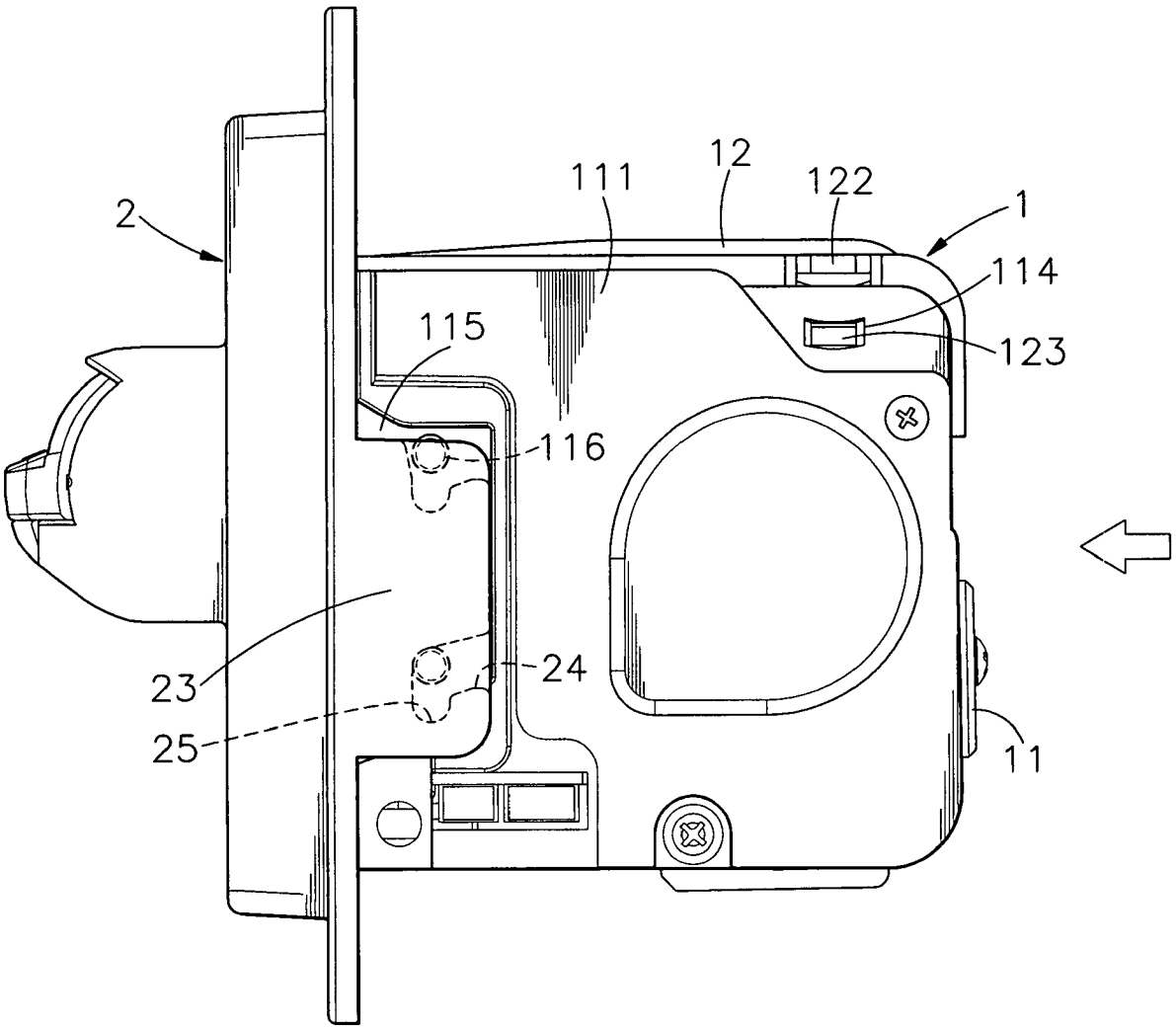
FIG. 9 is a schematic side view showing the stub guide rods of the lower unit of the bill acceptor respectively inserted into the horizontal guide grooves of the face panel according to the present invention.
Figure 10:
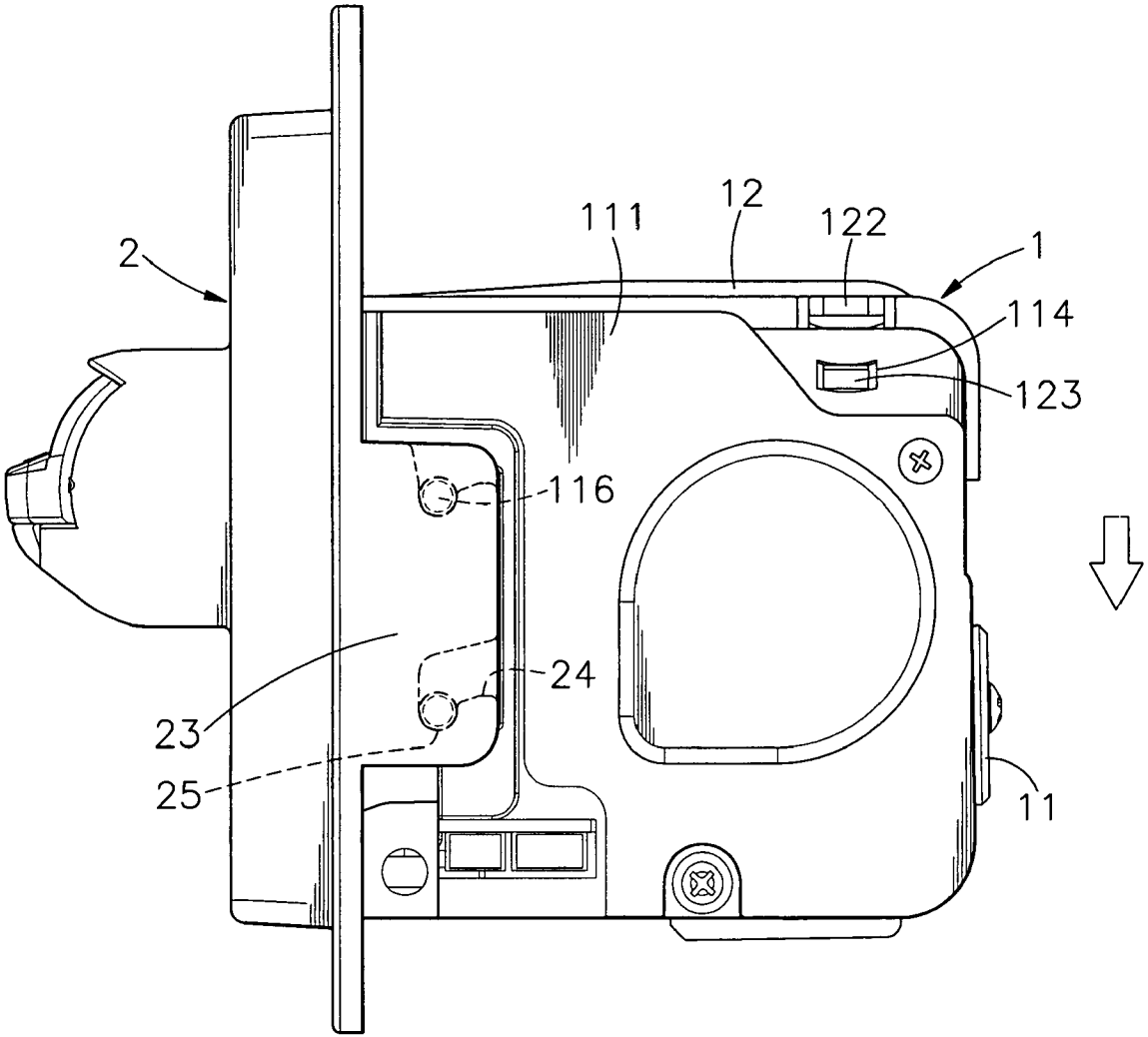
FIG. 10 corresponds to FIG. 9, showing the stub guide rods of the lower unit of the bill acceptor engaged into the vertical guide grooves of the face panel according to the present invention.

During installation, the mounting holes 26 of the face panel 2 are affixed to the vending machine's frame structure (not shown) with fastening means. Before fastening the bill acceptor 1 to the face panel 2, turn the upper unit 12 upwards relative to the lower unit 11 through an angle to tilt the locating blocks 124 downwardly (see FIG. 7), and then attach the bill acceptor 1 to the back side of the face panel 2 to insert the stub guide rods 116 into the horizontal guide grooves 24 and simultaneously to force the recessed locating portions 115 into engagement with the protruding locating plates 23 (see FIG. 9). When the stub guide rods 116 reach the respective inner ends of the horizontal guide grooves 24, the stub guide rods 116 are lowered into the associating vertical guide grooves 25, and therefore the bill acceptor 1 is firmly secured to the face panel 2 (see FIG. 10).

After installation of the bill acceptor 1 in the back side of the face panel 2, the upper unit 12 is turned downwards and closed on the lower unit 11 to force the locating blocks 124 into the retaining grooves 221 of the face panel 2 respectively. Thus, the stub guide rods 116 are firmly secured to the vertical guide grooves 25 of the face panel 2, preventing displacement of the bill acceptor 1 relative to the face panel 2. When wishing to detach the bill acceptor 1 from the face panel 2, disengage the hooks 123 from the retaining slots 114, and then turn the upper unit 12 upwards from the lower unit 11 to disengage the locating blocks 124 from the retaining grooves 221 of the face panel 2, and then move the lower unit 11 relative to the face panel 2 to disengage the stub guide rods 116 from the vertical guide grooves 25 and the horizontal guide grooves 24 of the face panel 2.

Figure 11:
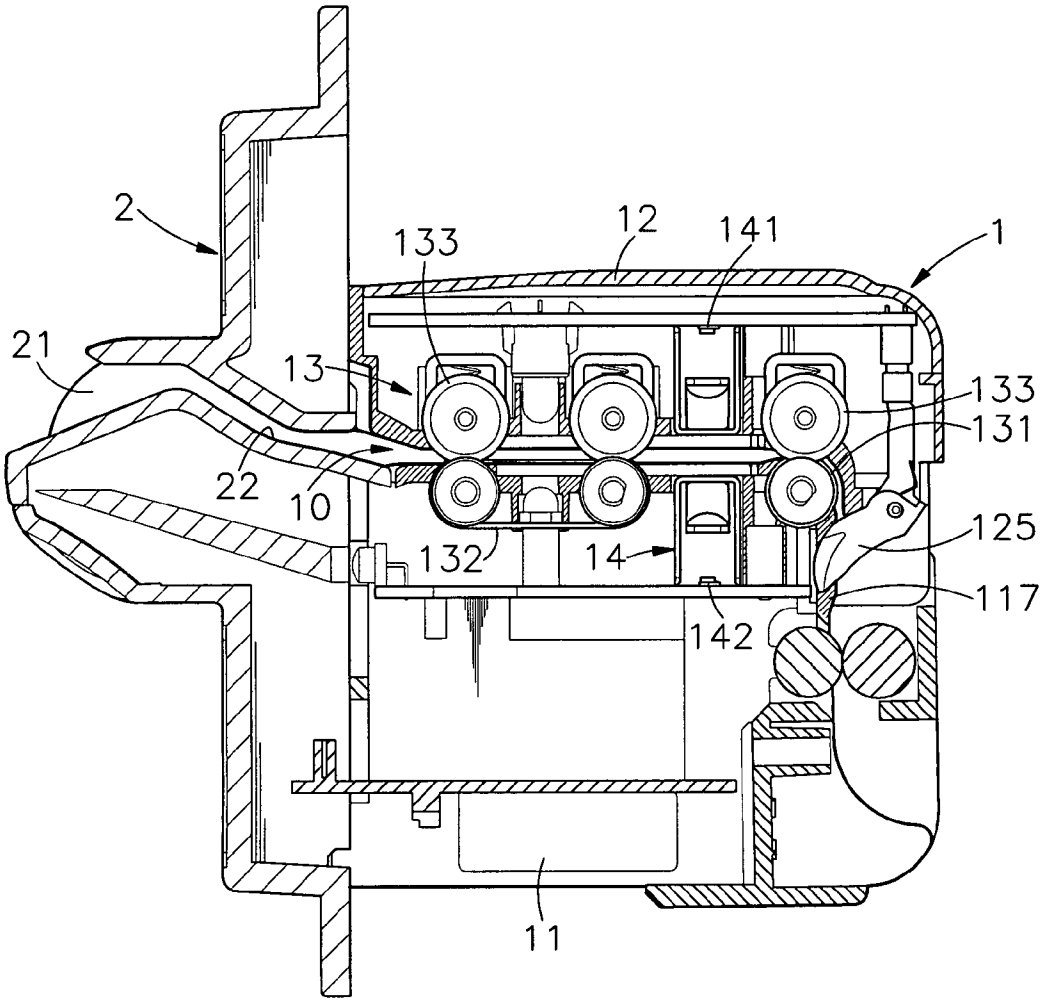
FIG. 11 is a schematic sectional side view of the present invention after installation of the bill acceptor in the face panel.
Figure 12:
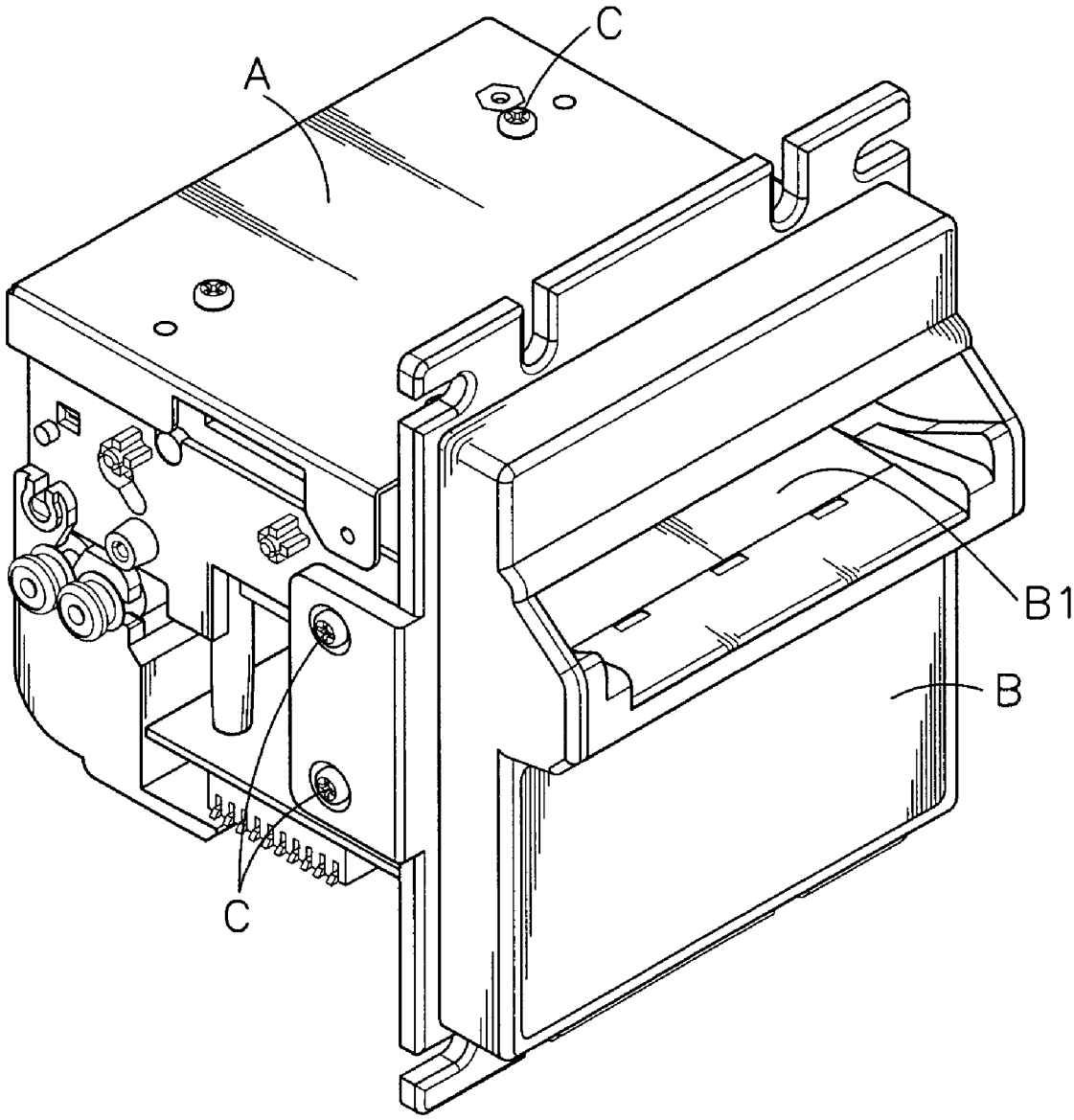
FIG. 12 is an oblique elevation of the prior art design.
Figure 13:
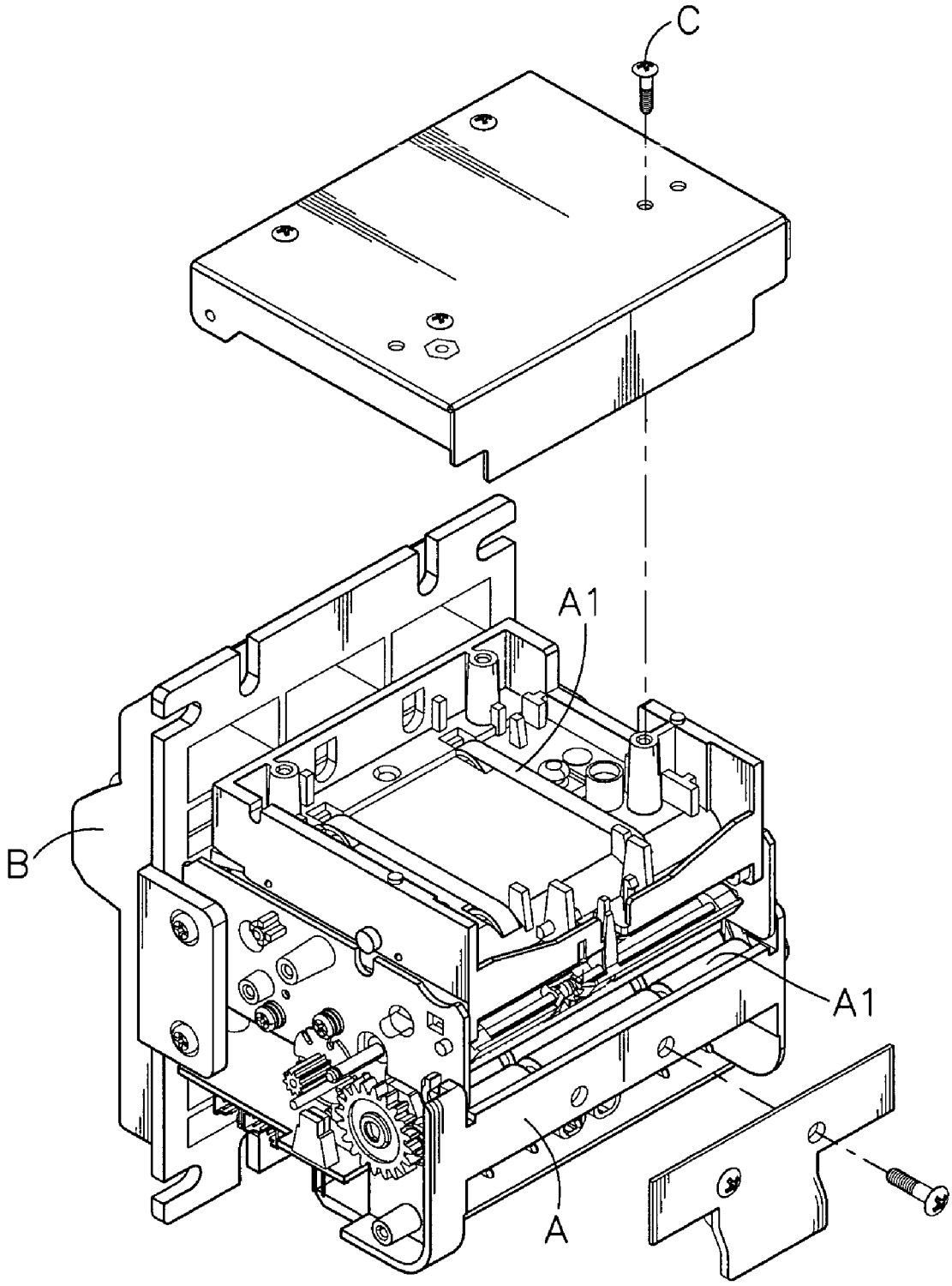
FIG. 13 is an exploded view of the prior art design.

After installation of the bill acceptor 1 in the face panel 2, the bill passage 22 of the face panel 2 is kept in communication with the bill path 10 of the bill acceptor 1 (see FIG. 11). When a bill is inserted through the bill slot 21 of the face panel 2 into the bill passage 22, the inserted bill will reach the bill path 10 of the bill acceptor 1 and then be carried forwards by the bill conveyer 13 and verified by the bill validator 14.

Further, because bills may carry a big amount of dust, chewing gum or other dirt, the bill transferring rolls 131 and the bill transferring belts 132 of the bill conveyer 13 will soon be covered with a layer of dust or dirt soon. When the bill transferring rolls 131 and the bill transferring belts 132 of the bill conveyer 13 are covered with a layer of dust or dirt, the bill conveying action of the bill conveyer 13 will become unstable, and the bill carrying on the bill conveyer 13 may be wrinkled or jammed in the bill path 10. Further, if the optical emitter module 141 and the optical receiver module 142 of the bill validator 14 are covered with dust or dirt, the verification accuracy of the bill validator 14 will lowered, or the bill validator 14 may be unable to work normally. In this case, a maintenance work is necessary.

During a maintenance work, the mechanic or worker can directly remove the bill acceptor 1 from the back side of the face panel 2 after opened the vending machine. When removing the bill acceptor 1 from the face panel 2, press the finger strips 122 to disengage the hooks 123 from the retaining slots 114 of the upright side panels 111, and then turn the upper unit 12 upwards from the lower unit 11 to disengage the locating blocks 124 from the retaining grooves 221 of the face panel 2, and then move the lower unit 11 relative to the face panel 2 to disengage the stub guide rods 116 from the vertical guide grooves 25 and the horizontal guide grooves 24 of the face panel 2. After removal of the bill acceptor 1 from the face panel 2, the upper unit 12 is fully opened from the lower unit 11. Thus, the necessary cleaning or repairing work is performed. If necessary, the upper unit 11 can be detached from the lower unit 12 by moving the flat pivot rods 121 out of the pivot holes 112 through the top grooves 113. After the cleaning or repair work is done, the bill acceptor 1 is installed in the face panel 2 again.

Further, the matching design of the security hooks 125 of the upper unit 12 and the security gate 117 of the lower unit 11 effectively prevents insertion of a metal wire or adhesive tape by an evil person to pick up bills from the bill box.

As indicated above, the invention provides a detachable bill acceptor mounting arrangement, which has the following features:

1. The lower unit 11 of the bill acceptor 1 has two recessed location portions 115 and two stub guide rods 116 in each of the two recessed location portion 115, and the face panel 2 has two horizontal guide grooves 24 and two vertical guide grooves 25 linked to the horizontal guide grooves 24 for receiving the stub guide rods 116. After insertion of the stub guide rods 116 into the vertical guide grooves 25 through the horizontal guide grooves 24, the upper unit 12 is closed on the lower unit 11 to force the locating blocks 124 into engagement with the retaining grooves 221 of the face panel 2, thereby prohibiting disengagement of the stub guide rods 116 from the vertical guide grooves 25. Reversing the aforesaid procedure allows removable of the bill acceptor 1 from the face panel 2. Therefore, the mounting and dismounting operations of the bill acceptor 1 are easy without tools.

2. After removal of the bill acceptor 1 from the face panel 2, the mechanic or worker can separate the upper unit 11 from the lower unit 12 for cleaning or repair by: pressing the finger strips 122 to disengage the hooks 123 from the associating retaining slots 114, and then turning the upper unit 12 from horizontal to vertical, and then lifting the upper unit 12 to move the flat pivot rods 121 out of the associating pivot holes 112 through the associating top grooves 113.

A prototype of detachable bill acceptor mounting arrangement has been constructed with the features of FIGS. 1-11. The detachable bill acceptor mounting arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A detachable bill acceptor mounting arrangement comprising: a face panel of a vending machine, said face panel having a bill slot for the insertion of a bill and a bill passage backwardly extending from said bill slot to a back side of said face panel, and a bill acceptor detachably mounted on the back side of said face panel, said bill acceptor comprising a lower unit, an upper unit mounted on said lower unit, a bill path defined between said lower unit and said upper unit in communication with said bill passage, a bill conveyer mounted in said lower unit for carrying a bill from said bill passage through said bill path, and a bill validator adapted to verify the authenticity of the bill being carried by said bill conveyer through said bill path;

wherein:

said lower unit comprises two upright side panels, said upright side panels each having an outer wall, an inner wall opposite to said outer wall, a pivot hole on said inner wall, a recessed locating portion on said outer wall, a plurality of stub guide rods suspending in said recessed locating portion, and a retaining slot cut through said outer wall and said inner wall near a rear side;

said upper unit is set between said two upright side panels of said lower unit, comprising two flat pivot rods respectively extended from two opposite lateral sides thereof near a front side and respectively pivotally coupled to said pivot holes on said upright side panels of said lower unit, a plurality of locating blocks at a front side thereof, and two hooks respectively extended from the two opposite lateral sides of said upper unit near a rear side for engaging said retaining slots of said lower unit;

said face panel comprises two protruding locating plates backwardly extending from two opposite lateral sides for engaging into said recessed location portions of said lower unit of said bill acceptor, said protruding locating plates each having guide groove means for receiving said stub guide rods of said lower unit to secure said lower unit to said face panel, and a plurality of retaining grooves on the back side above said bill passage for receiving said locating blocks of said upper unit of said bill acceptor.

2. The detachable bill acceptor mounting arrangement as claimed in claim 1, wherein said upright side panels of said lower unit each have a top groove vertically upwardly extending from said respective pivot hole thereof to the topmost edge of said respective upright side panel; said flat pivot rods are insertable through said top grooves of said upright side panels into said pivot holes when said upper unit is kept in vertical above said lower unit.

3. The detachable bill acceptor mounting arrangement as claimed in claim 1, wherein said upper unit of said bill acceptor comprises two finger strips respectively protruded from the two opposite lateral sides of said upper unit; said hooks of said upper unit are respectively protruded from said finger strips for engaging said retaining slots of said lower unit and disengageable from said retaining slots of said lower unit when said finger strips are pressed inwards by an external force.

4. The detachable bill acceptor mounting arrangement as claimed in claim 1, wherein said bill conveyer comprises a plurality of bill transferring rolls and bill transferring belts mounted in said lower unit for conveying bills, and a plurality of impression rolls pivotally mounted in said upper unit and adapted to press bills on said bill transferring rolls and said bill transferring belts for enabling bills to be delivered through said bill path.

5. The detachable bill acceptor mounting arrangement as claimed in claim 1, wherein said bill validator comprises an optical emitter module installed in said upper unit above said bill path, and an optical receiver module installed in said lower unit below said bill path.

6. The detachable bill acceptor mounting arrangement as claimed in claim 1, said guide groove means of each of said protruding locating plates of said face panel includes a horizontal guide groove horizontally extending to a rear side of said respective protruding locating plate and a vertical guide groove downwardly extending from an inner end of said horizontal guide groove.

7. The detachable bill acceptor mounting arrangement as claimed in claim 1, wherein said lower unit of said bill acceptor has a security gate at a rear side thereof; said upper unit of said bill acceptor has a row of security hooks suspending in a rear side thereof for engaging into said security gate.

8. The detachable bill acceptor mounting arrangement as claimed in claim 1, wherein said face panel has a plurality of mounting holes around the border thereof for fastening to a framework of the vending machine.

* * * * *